US010865706B1

(12) United States Patent
Lowe et al.

(10) Patent No.: US 10,865,706 B1
(45) Date of Patent: Dec. 15, 2020

(54) SPHERICAL LINEAR TWO STROKE ENGINE

(71) Applicants: Steven F Lowe, White Lake, MI (US); Cliff Carlson, Fenton, MI (US)

(72) Inventors: Steven F Lowe, White Lake, MI (US); Cliff Carlson, Fenton, MI (US)

( * ) Notice: Subject to any disclaimer, the term of this patent is extended or adjusted under 35 U.S.C. 154(b) by 0 days.

(21) Appl. No.: 16/537,304

(22) Filed: Aug. 9, 2019

Related U.S. Application Data

(60) Provisional application No. 62/717,662, filed on Aug. 10, 2018.

(51) Int. Cl.
*F02B 75/02* (2006.01)
*F01B 3/02* (2006.01)
*F02B 75/28* (2006.01)

(52) U.S. Cl.
CPC ..... *F02B 75/02* (2013.01); *F01B 3/02* (2013.01); *F02B 75/28* (2013.01); *F02B 2075/025* (2013.01)

(58) Field of Classification Search
CPC ..... F02B 75/02; F02B 75/28; F01B 3/02
See application file for complete search history.

(56) References Cited

U.S. PATENT DOCUMENTS 1,476,275 A * 12/1923 Wishon ..... F01B 3/0005 123/56.6
1,978,194 A * 10/1934 Gray ..... F02B 75/26 123/41.74
2,465,638 A * 3/1949 Eckert ..... F02B 75/26 123/51 A
4,285,303 A * 8/1981 Leach ..... F01B 3/0005 123/51 BA
4,489,682 A * 12/1984 Kenny ..... F01B 3/0005 123/51 B
2008/0302343 A1* 12/2008 Carlson ..... F01B 3/0005 123/564

FOREIGN PATENT DOCUMENTS

GB 251630 A * 4/1926

* cited by examiner

*Primary Examiner* — Kevin A Lathers
(74) *Attorney, Agent, or Firm* — Ronald R. Kilponen

(57) ABSTRACT

A spherical linear two stroke engine (SLE) is shown and described. SLE is an opposed piston two stroke (OP2S), free piston engine with controlled power shaft. SLE is scalable, light in weight, small in packaging volume, has few parts and high power density. The SLE is also efficient, environmentally friendly and has many different applications.

1 Claim, 7 Drawing Sheets

SPHERICAL LINEAR TWO STROKE ENGINE

CROSS REFERENCE TO RELATED APPLICATIONS

This application claims the benefit of U.S. Provisional Application No. 62/717,662 filed on Aug. 10, 2018 entitled "Spherical Linear Two Stroke Engine". The above identified Provisional Application for Patent is herein incorporated by reference in its entirety to provide continuity of disclosure.

FIELD

SLE (Spherical Linear Engine) is a novel unique design. SLE is an OP2S (Opposed piston two stroke) uni-flow engine. SLE is a free piston engine with a controlled power output shaft and operating range.

The following represents a global view of advantages SLE will offer:

- Disruptive technology that will surpass current combustion engine performance capabilities.
- Will set a new standard and raise the bar.
- Disruptive packaging for all combustion engine applications.
- Massive reduction in size, weight including noise and vibration.
- Scalable from lawnmower to ship.
- Increased power, efficiency and fuel economy.
- Will exceed all future environmental and fuel consumption mandates.

BACKGROUND

These embodiments relate to internal combustion engines, and more particularly to a spherical linear two stroke engine (SLE). There are many different types of engines being used currently in the market for everything from micro models to huge ships. Many times the engines are optimized for the type of work that they are going to do. Many of the engines are enormous and can only run at limited rpms to produce power and torque, as an example in freight ships.

At the other end of the spectrum are engines that run model cars/air planes which are tiny two cycle engines that work off of glow plugs. Other examples between these two extremes use various parameters to optimize the engines for the types of loads, service environment, endurance, durability and many other factors.

Outboard motors are another example of two cycle engines that have been utilized for many years. Until recently, when the market began to develop and sell four cycle engines to replace the two cycle outboards because of environmental concerns. These new four cycle outboard motors are considerably heavier, bigger and more expensive. It would be beneficial to have a very high power density, lightweight, small foot print and easily packaged engine.

For the foregoing reasons, there is a need for a novel two cycle engine that can be easily manufactured, cost effective to operate, scalable and meets or exceeds all current and upcoming environmental and fuel consumption mandates.

SUMMARY

In view of the foregoing disadvantages inherent in the current two cycle engine field there is a need for a spherical linear engine (SLE).

A first objective of these embodiments is to provide a two stroke engine that will set a new standard for power density, packaging and efficiency.

Another objective of these embodiments is to provide a two stroke engine that can be scalable from a small size to a large size and thereby suitable for many different applications and environments.

It is yet another objective of these embodiments to provide a two stroke engine that is fuel efficient.

It is a still further objective of these embodiments to provide a two stroke engine that can be manufactured in a cost effective manner.

An additional objective of these embodiments is to provide a two stroke engine that is environmentally friendly.

Another objective of these embodiments is to provide a two stroke engine that is durable and relatively easy to fix should service be required.

These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings and descriptive matter in which there is illustrated a preferred embodiment.

DETAILED DESCRIPTION OF THE PREFERRED EMBODIMENTS

Figure 1:
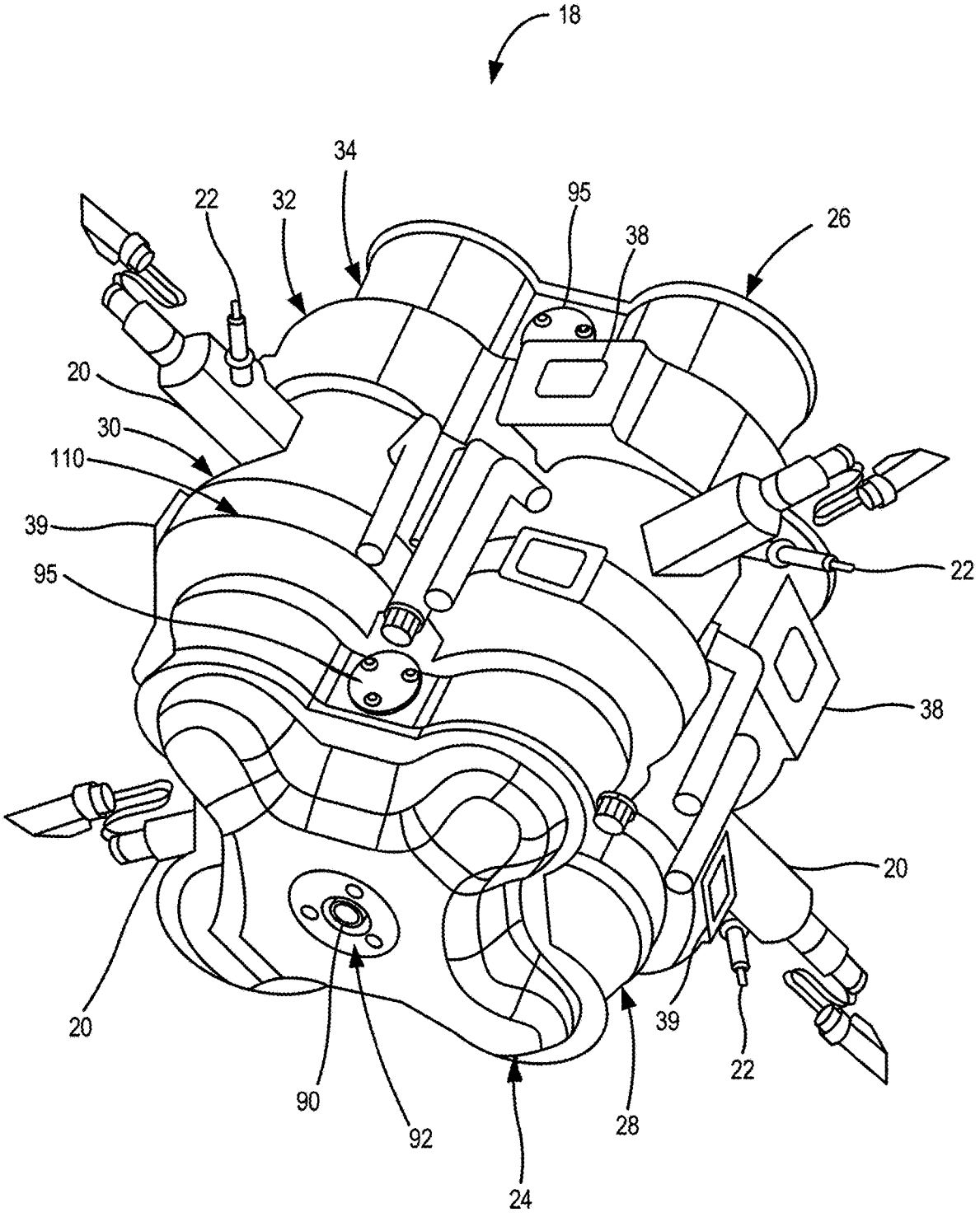
FIG. 1 shows a side perspective view of one embodiment of a Spherical Linear two Stroke Engine (SLE).

Referring to the drawings in detail wherein like elements are indicated by like numerals, there is shown in FIG. 1 a side perspective view of one embodiment of the Spherical Linear two Stroke Engine (SLE) 18. The SLE 18 has a first end cover 24 on one end connected to a first wobbler housing 28. The first wobbler housing 28 is then connected to the cylinder sleeve 110 which is in turn connected to the intake housing 32. The intake housing 32 is connected to the second wobbler housing 34 which terminates in a second end cover 26. It can be seen that there are four fuel injector pre-chambers 20 connected to the cylinder sleeves 110. This embodiment of the fuel injector pre-chamber 20 shows a spark plug 22 to fire the air fuel charge into the cylinder sleeve 110.

Near the center of the first end cover 24 is located a wobbler plate 92. Wobbler plate 92 is attached to a rotating power shaft 108 by fastener 90. Likewise, near the center of the second end cover 26 is located a second wobbler plate 92 (not shown) affixed to the same rotating power shaft 108 by another fastener 90. The power shaft 108 runs through first spider plate 98 and pivot ball 106 through second pivot ball 106 and second spider plate 97 and is attached to wobbler plates 92 (one on each end) secured by fasteners 90, FIG. 4.

In other words, the power shaft 108 interconnects the first wobbler plate 92 and fastener 90 on one end to the first spider plate 98 and pivot ball 106 on first end to the second pivot ball 106, second spider plate 97 and second wobbler plate 92 via second fastener 90 on the second end.

This portion of description will focus on one end of the SLE 18 to illustrate how this one embodiment produces power to the power shaft 108. It should be understood that other components in this device function in the same manner and this explanatory section is to aid the readers understanding of the functioning of the SLE 18.

As each pair of piston assemblies 149 move back and forth, this causes the first spider plate 98 to move one arm 99 of the spider plate 198 closer to and away from the piston assemblies 149. As this occurs, the wobbler plate 92 begins to rotate. Since the wobbler plate 92 is affixed to the power shaft 108 this causes the power shaft 108 to rotate. As the piston assemblies 149 in the device continue to move back and forth in this co-ordinated manner the arms 99 of the spider plate 198 move closer to and away from the piston assemblies 149. This results in the wobbler plate 92 spinning thereby driving the power shaft 108.

Second and first spider plates 97, 98 articulate with wobble reciprocation on pivot ball 106. This wobble articulation is generated by wobbler plate 92 which is secured to power shaft 108 by fasteners 90. Torque translation mechanism 95 has a torque translation surface 96. The torque translation mechanism 95 is secured to first and second wobbler housings 28, and 34, FIG. 1. Translation surface 96 runs in a formed groove in second and first spider plates 97, 98 and transfers combustion force to SLE 18 which allows power shaft 108 to rotate. Translation surface 96 also does not allow spider plates 97, 98 to rotate only reciprocate. There is an intake port 38 seen located in the intake housing 32, FIG. 1. There is an exhaust port 39 located in exhaust housing 30.

Figure 2:
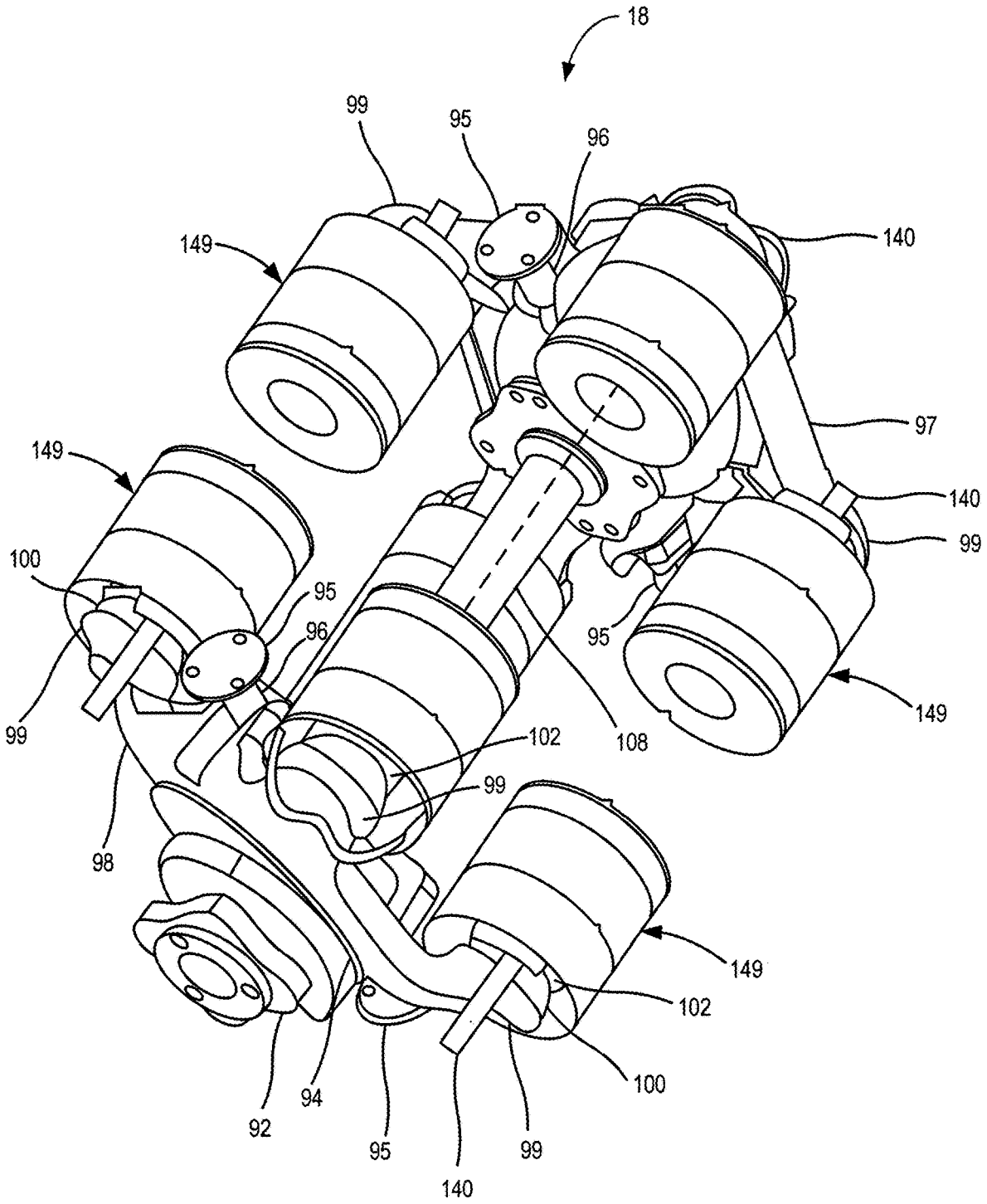
FIG. 2 shows a side perspective cutaway view of the embodiment in FIG. 1 showing some of the internal components of an SLE.
Figure 3:
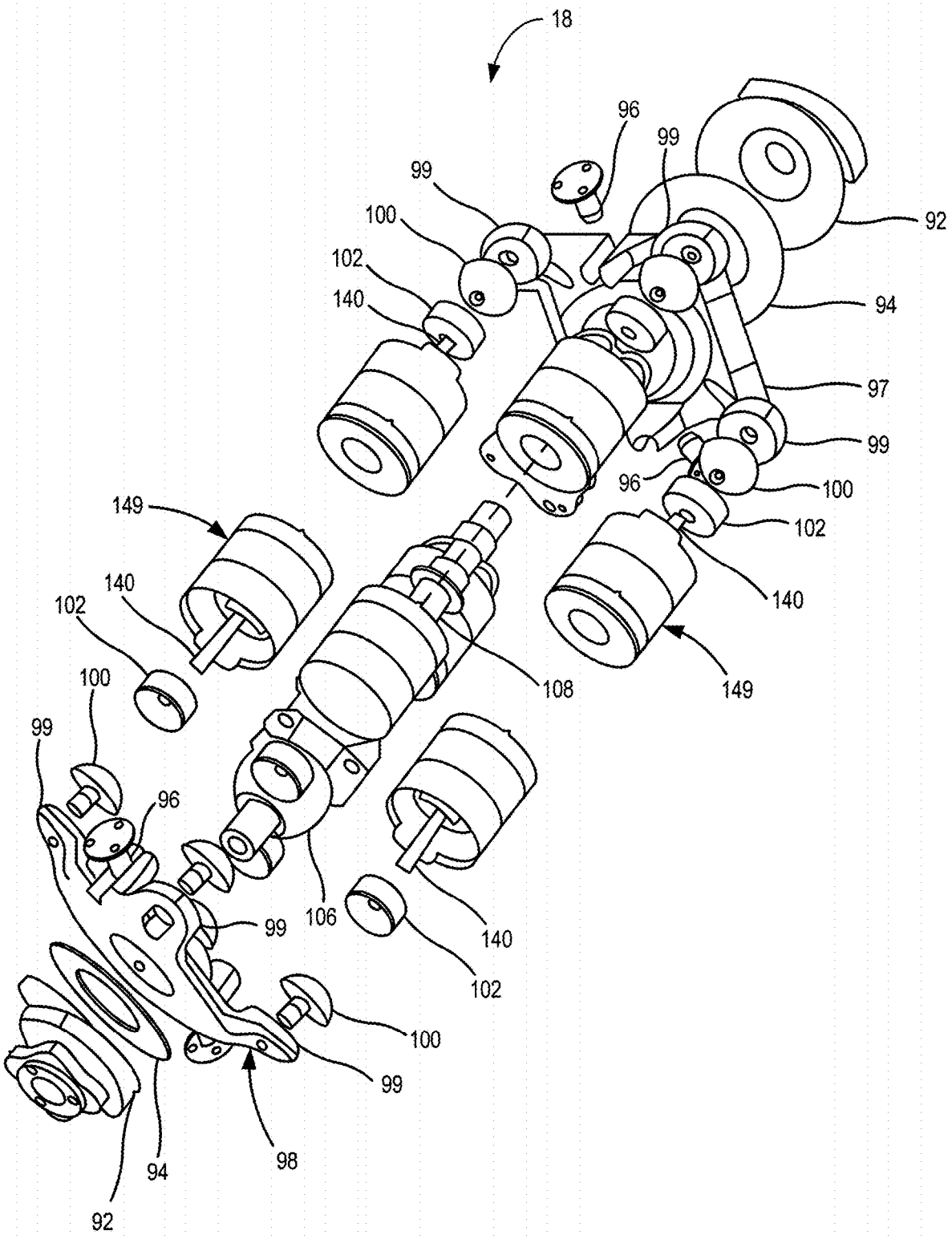
FIG. 3 shows a side perspective view of some of the internal components in FIG. 2 exploded to better understand their inter-connectivity.

FIG. 2 shows a perspective view of one embodiment of the internal components of the SLE 18. In FIGS. 2,3 can be seen a wobbler plate 92 contacting a thrust bearing 94. The thrust bearing 94 engages the first spider plate 98 which has four arms 99. Each of the arms 99 has a puck driver 100, a transfer puck 102 and a piston assembly 149 free floating. The same applies for the opposite side of second spider plate 97. This discussion will be limited to the operation of one pair of piston assemblies for discussion purposes and it should be understood that the other pairs of piston assembly 149, transfer puck 102, puck driver 100 in this SLE 18 function in the same manner.

FIG. 3 shows an exploded perspective and better details of how these components of one embodiment are assembled. In operation (as an example), the wobbler plate 92 rotates to pull the arm 99 away from the center of the SLE 18. As this occurs, the puck driver 100 and transfer puck 102 with retention from the retention spring 140 (FIGS. 3, 4) draws the piston assembly 149 in a motion away from top dead center without separation of these elements. This allows the cylinder to fill with air. The retention spring 140 is only needed until there is cylinder pressure. As the cylinder fills, the wobbler plate 92 continues to rotate such that the piston assembly 149, transfer puck 102, puck driver 100 arm 99, second and first spider plates 97, 98 moves closer to the center of the SLE 18 and thereby closer to one another compressing the air. As the combustion chamber is pressurized, Fuel injector Pre-chamber 20 injects fuel. The fuel is ignited, there by creating combustion, this forces the piston assemblies 149, transfer puck 102, puck driver 100, arm 99 and second and first spider plates 97, 98 to reciprocate away from TDC of SLE 18 causing wobbler plate 92 and power shaft 108 to rotate generating rotational torque.

This same process occurs with the other pairs of piston and associated assemblies 149, 102, 100, 99, 98, 97, 92, 108 on the other end of the SLE 18.

Figure 4:
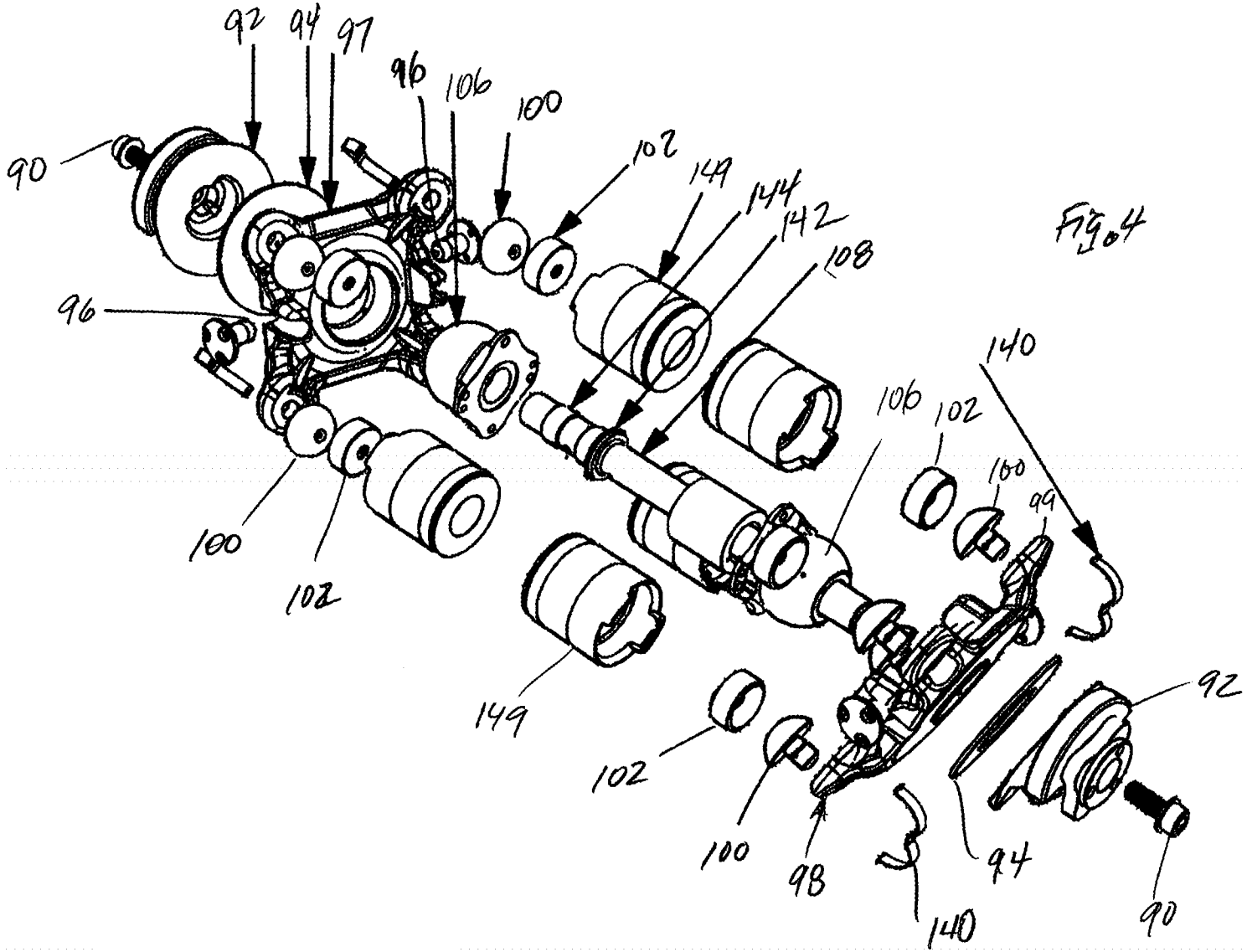
FIG. 4 shows a side perspective exploded view of the internal components of one embodiment.

FIG. 4 shows a side perspective exploded view of some components of the SLE 18. This shows a secondary thrust bearing 142 and power shaft bearing 144 on the center power shaft 108. Also seen here is the torque translation mechanism 95 which interfaces with the second and first spider plates 97, 98 and is secured by first and second wobbler housings 28 and 34, FIG. 1. Torque translation mechanism 95 with torque translation surface 95 drives energy from combustion to power shaft 108 rotation via SLE 18 block elements. This eliminates side force on piston assembly 149. Piston assembly 149 and associated hardware such as transfer puck 102 are free floating with no restraints, thus a free piston engine. This is constant throughout. There is shown one torque translation mechanism 95 with torque translation surface 96 opposite one another for a total of two torque translation mechanisms 95 with torque translation surfaces 96 interfacing with second and first spider plates 97, and 98 (not shown for first spider plate 98). More torque translation mechanisms 95 having torque translation surfaces 96 are feasible in another embodiment.

Also shown is a pair of pivot balls 106. Pivot balls 106 allow second and first spider plates 97, 98 to reciprocate freely allowing low friction, piston motion to generate power shaft 108 rotational torque. It can be seen how the retention spring 140 (FIGS. 3, 4), retains the piston assembly 149 to the transfer puck 102 and the puck driver 100 during low to no cylinder pressure. The puck driver 100 is then retained thereby in the arm 99 of the second and first spider plates 97 and 98.

Figure 5:
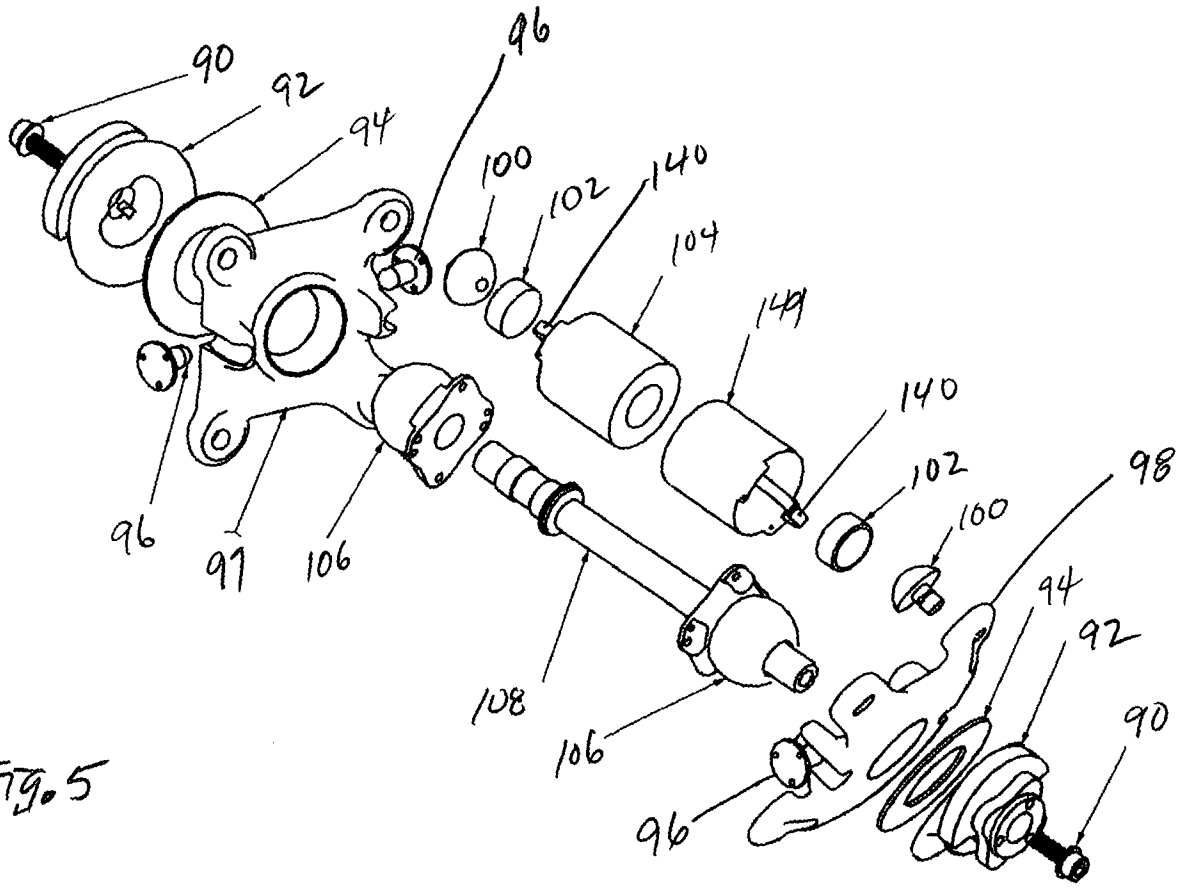
FIG. 5 shows a simplified side perspective partial exploded view of the internal components of one embodiment.

FIG. 5 shows a simplified side perspective exploded view of limited elements for better visual understanding of their interfaces. In this view, the pivot balls 106 are shown. Pivot balls 106 are affixed to the intake housing 32 and first wobbler housing 28, not shown. Power shaft 108 rotates freely via bearings through pivot balls 106. Pivot balls 106 allow second and first spider plates 97, 98 to articulate reciprocating motion. FIG. 5 also shows a piston 104 and piston assembly 149.

Figure 6:
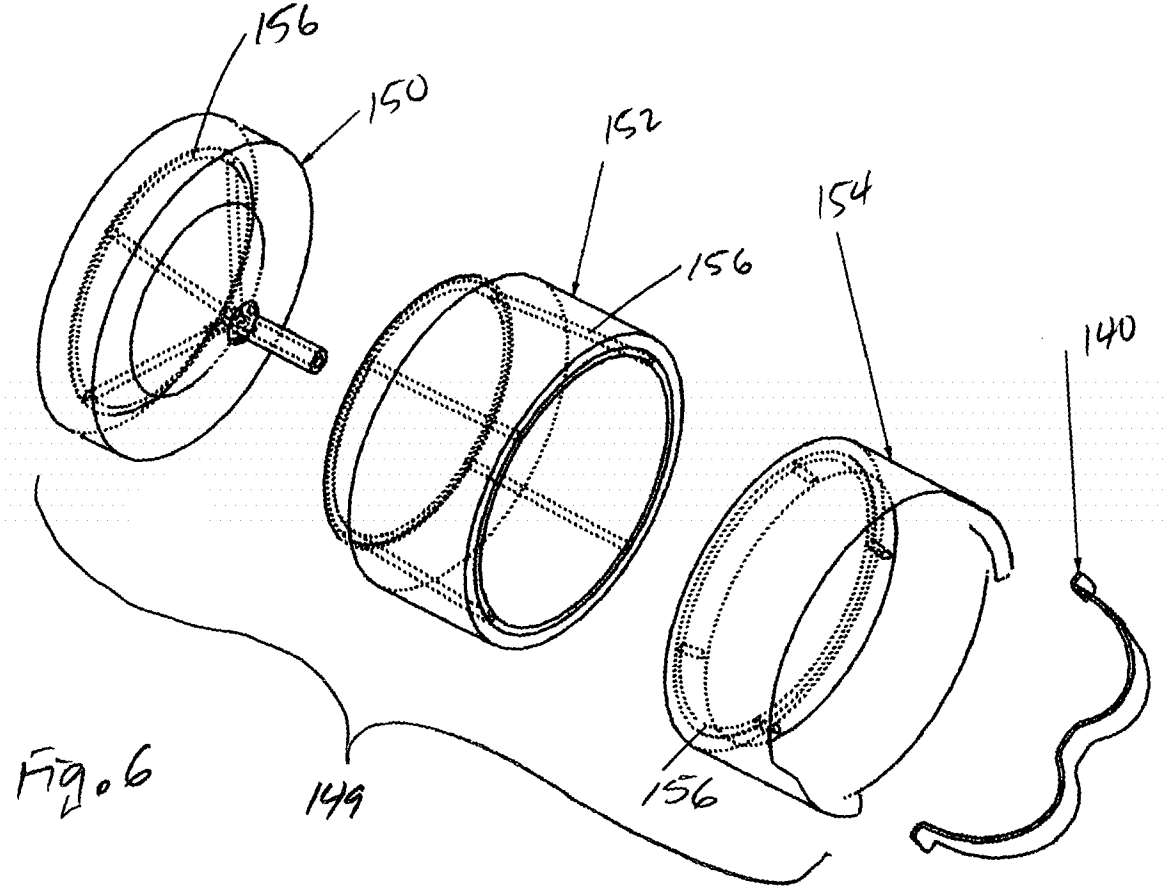
FIG. 6 shows an exploded view of one embodiment of a piston assembly.

FIG. 6 shows one embodiment of the piston assembly 149. It can be seen that the piston assembly 149 has a piston top 150 connected to a piston body 152 which in turn is connected to a piston skirt 154. These components also show oil passages 156 which feeds oil to each of the piston assembly 149 elements to keep them cool and help prevent wear. The retention spring 140 retains the piston assembly 149 to the puck driver 100 and the transfer puck 102 when there is no cylinder pressure. In another embodiment, piston top 150, piston body 152, piston skirt 154 can be eliminated if the entire piston assembly 149 is 3D metal printed as one unit with internal oiling passages thereby forming piston 104.

Figure 7:
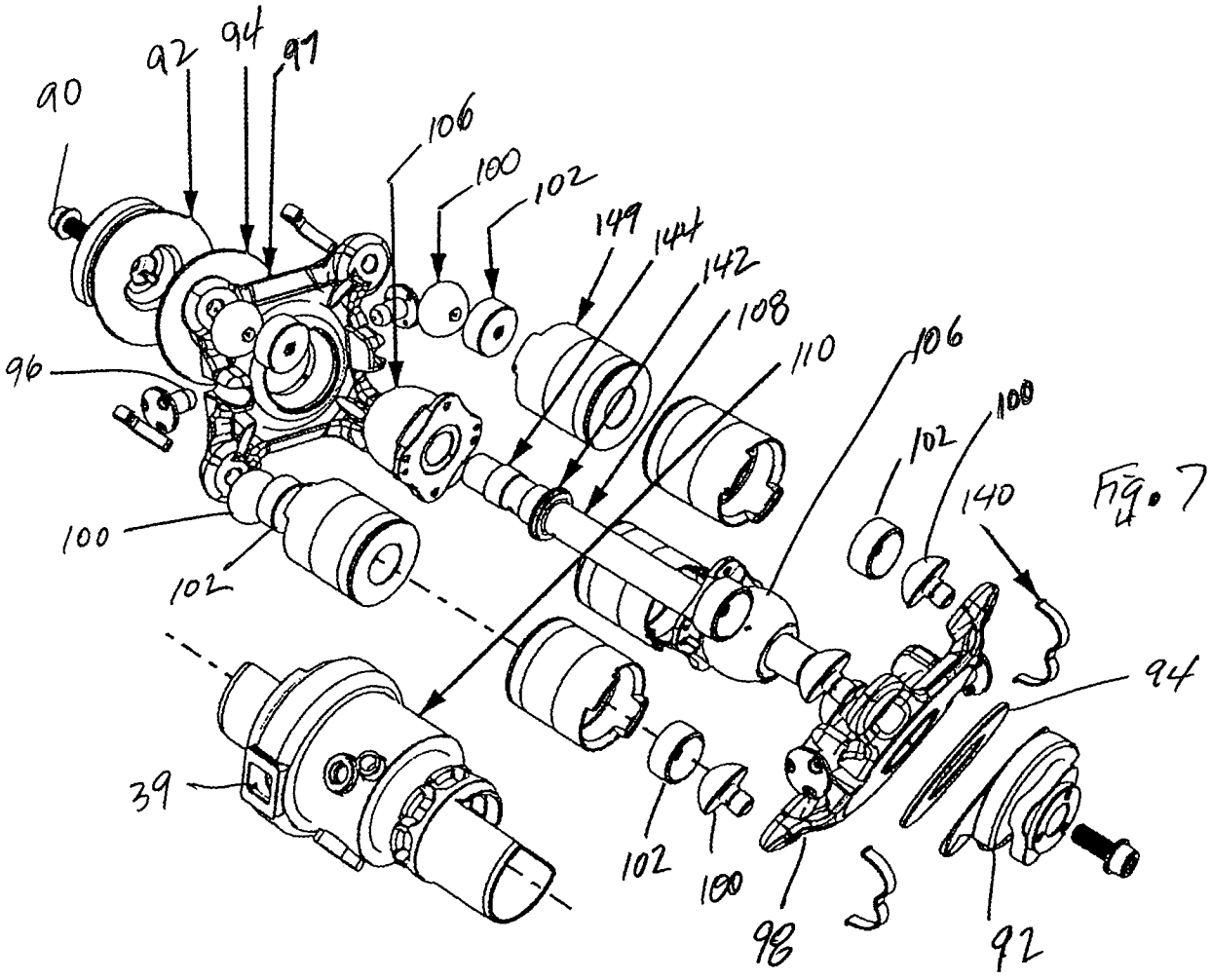
FIG. 7 shows a perspective exploded view of some of the internal components of one embodiment.

FIG. 7 shows a perspective exploded view of internal components of one embodiment also including the cylinder sleeve 110. The cylinder sleeve 110 engages the piston assembly 149 and houses the fuel injector pre-chamber 20 and other components.

It will now be apparent to those skilled in the art that other embodiments, improvements, details and uses can be made consistent with the letter and spirit of the foregoing disclosure and within the scope of this application, which is limited only by the following claims, construed in accordance with the patent law, including the doctrine of equivalents.

The invention claimed is:

1. A Spherical linear two stroke engine, the engine comprising:

a first end cover;

a first wobbler housing;

an exhaust housing;

a cylinder sleeve;

an intake housing;

a second wobbler housing;

a second end cover;

the first end cover affixed to the first wobbler housing;

the first wobbler housing affixed also to the exhaust housing;

the exhaust housing also affixed to the cylinder sleeve;

the cylinder sleeve also affixed to the intake housing;

the intake housing also affixed to the second wobbler housing;

the second wobbler housing also affixed to the second end cover;

a power shaft having a first end and a second end, the first end affixed to the first end cover with a fastener, the second end affixed to the second end cover with a fastener;

a pivot ball attached to the power shaft near the first end, a second pivot ball attached to the power shaft near the second end;

a power shaft bearing and a secondary thrust bearing located on the power shaft between the first and second ends;

a wobbler plate affixed to the first end of the power shaft, a second wobbler plate affixed to the second end of the power shaft;

the power shaft having a first spider plate on the first end, a thrust bearing located between the first spider plate and the first wobbler plate;

the power shaft having a second spider plate on the second end, a thrust bearing located between the second spider plate and the first wobbler plate;

the power shaft having a first pivot ball, the first pivot ball adjacent to the first spider plate, a second pivot ball, the second pivot ball adjacent to the second spider plate;

the first spider plate having a plurality of arms, the second spider plate having a plurality of arms, one arm of the first spider plate spaced in a co-linear relationship to a corresponding arm of the second spider plate;

a puck driver and a transfer puck engaging each of the co-linear arms of the first and second spider plates;

a pair of piston assemblies located between the puck driver and transfer puck of each pair of co-linear arms of the spider plates;

a retention spring for retaining the each piston assembly to the adjacent transfer puck and the puck driver;

the first wobbler plate contained within the first end cover, the first spider plate contained within the first wobbler housing, the piston assemblies contained within the cylinder sleeve, the second spider plate contained within the second wobbler housing, the second wobbler plate contained within the second end cover;

the cylinder sleeve containing at least one intake port, the intake port for receiving combustion fuel;

the cylinder sleeve containing at least one exhaust port, the exhaust port for dispensing burned fuel;

the cylinder sleeve containing a fuel injector pre chamber for feeding fuel to the piston assemblies for combustion;

a spark plug affixed to the fuel injector pre chamber for providing a spark to the air and fuel mixture;

a torque translation mechanism having a torque translation surface, the torque each spider plate having at least one torque translation mechanism; and wherein as the spider plate translates, the wobbler plate wobbles and causes the power shaft to rotate thereby providing rotational torque to the device being powered.

* * * * *